United States Patent [19]

Eriksson et al.

[11] Patent Number: 4,914,886

[45] Date of Patent: Apr. 10, 1990

[54] DEVICE FOR LAYING OUT PROFILED SHEET

[75] Inventors: Anders Eriksson; Jan Strömberg, both of Luleå, Sweden

[73] Assignee: Plannja AB, Luleå, Sweden

[21] Appl. No.: 155,529

[22] Filed: Feb. 12, 1988

[30] Foreign Application Priority Data

Feb. 16, 1987 [SE] Sweden ..... 8700622

[51] Int. Cl.[4] ..... E04D 1/00

[52] U.S. Cl. ..... 52/537; 52/551

[58] Field of Search ..... 52/DIG. 15, 537, 551

[56] References Cited

U.S. PATENT DOCUMENTS

| | | | |
|---|---|---|---|
| 3,332,186 | 7/1967 | Cammaert | 52/537 |
| 3,657,849 | 4/1972 | Carton | 52/537 |
| 3,959,942 | 6/1976 | Merson | 52/537 |

FOREIGN PATENT DOCUMENTS

| | | | |
|---|---|---|---|
| 615772 | 6/1961 | Italy | 52/551 |
| 330554 | 2/1930 | United Kingdom | 52/537 |
| 1283758 | 8/1972 | United Kingdom | 52/537 |

*Primary Examiner*—Henry E. Raduazo

*Attorney, Agent, or Firm*—Fleit, Jacobson, Cohn, Price, Holman & Stern

[57] ABSTRACT

Profiled roofing sheets for buildings are reinforced by supporting members (10) in an area of a roof structural support member (2) carrying the profiled sheets (1). The supporting members (10) are profiled and intended to be placed between the beam (2) and the profiled sheet (1). A supporting member is first placed on the structural support member and a profiled roofing sheet is thereafter laid on top of the supporting member after which a further supporting member is placed on the structural support member, the further supporting member connecting to the previously laid-out profiled roofing sheet and/or the previously placed supporting member in an upwardly guiding way, after which another profiled sheet is laid out on top of the further supporting member etc.

9 Claims, 3 Drawing Sheets

DEVICE FOR LAYING OUT PROFILED SHEET

BACKGROUND OF THE INVENTION

1. Field of the Invention

This invention relates to laying out profiled roofing sheets for buildings, the profiled sheets being reinforced by means of supporting members in an area of a beam or other roof structural support member carrying the profiled sheet, the supporting members consisting of profiled members intended to be placed between the beam and the profiled sheet. The invention also relates to supporting members for supporting the.

2. Description of the Prior Art

It is known to reinforce profiled sheet for building purposes, for example roofing sheet, by means of so-called supporting members in areas where the sheet rests on top of beams in order to prevent deformation of the profiled sheet in its contact area against the beam when the profiled sheet carries a load, for example a snow load. By these local reinforcing measures a thinner profiled sheet can be used.

Previously e.g. supporting members premounted on the beams before the profiled sheets are placed on the beams and also before said beams have been mounted to the framework of the building have been used. Such premounting means that deviations of measures of the supporting members give rise to great problems when the profiled sheets thereafter are laid out. Moreover, due to undesired movements between the beams the premounted supporting members have not been aligned with one another with the result that the profiled sheet could not be mounted owing to its stiffness and inability of adapting itself to said movements.

The alternative of first mounting the beams to the framework of the building and thereafter all the supporting members onto the beams requires a balancing act by the fitter and is therefore not an attractive solution.

BRIEF SUMMARY OF THE INVENTION

According to the present invention the supporting members are successively placed on the roof structural support member so that profiled sheets already laid out or supporting members located beneath them serve as a pattern for mounting additional supporting member.

In order to enable the successive mounting of the supporting members, they are formed according to the invention so that they connect to a previously laid-out profiled sheet and/or a previously laid-out supporting member in an upwardly guiding way.

Thus, it is the object of this invention to provide a device enabling an extraordinarily simple and economic mounting of the supporting members in connection with the profiled sheet being laid out and a roofing structure utilizing the device. This object is achieved by providing supporting strips each having a profile to complement or conform substantially to the sheeting being attached, the supporting strips being between the sheeting and the beam, so that the entire structure comprises a first supporting strip on the beam, a first profile roofing sheet on the first strip to form the combination of a first profile assembly, a second supporting strip on the beam positioned endwise with the first strip and having an end portion overlapped or underlapped with an end portion of the first assembly, and a second profile sheet on the second strip. In one embodiment the second strip is overlapped over an end portion of the first roofing sheet. In a second configuration the end portion of a second strip overlaps the end portion of the first strip and has a protruding rib thereon engaging in a corresponding groove in the overlying end portion of the first roofing sheet. The end portion of the second strip may also be extended and have an upwardly turned edge portion to engage on the upperwardly extending side of the overlapped portion of the first roofing sheet.

BRIEF DESCRIPTION OF THE DRAWINGS

Illustrative examples of the invention will be described in the following with reference to the accompanying drawings, wherein.

DETAILED DESCRIPTION

Figure 1:
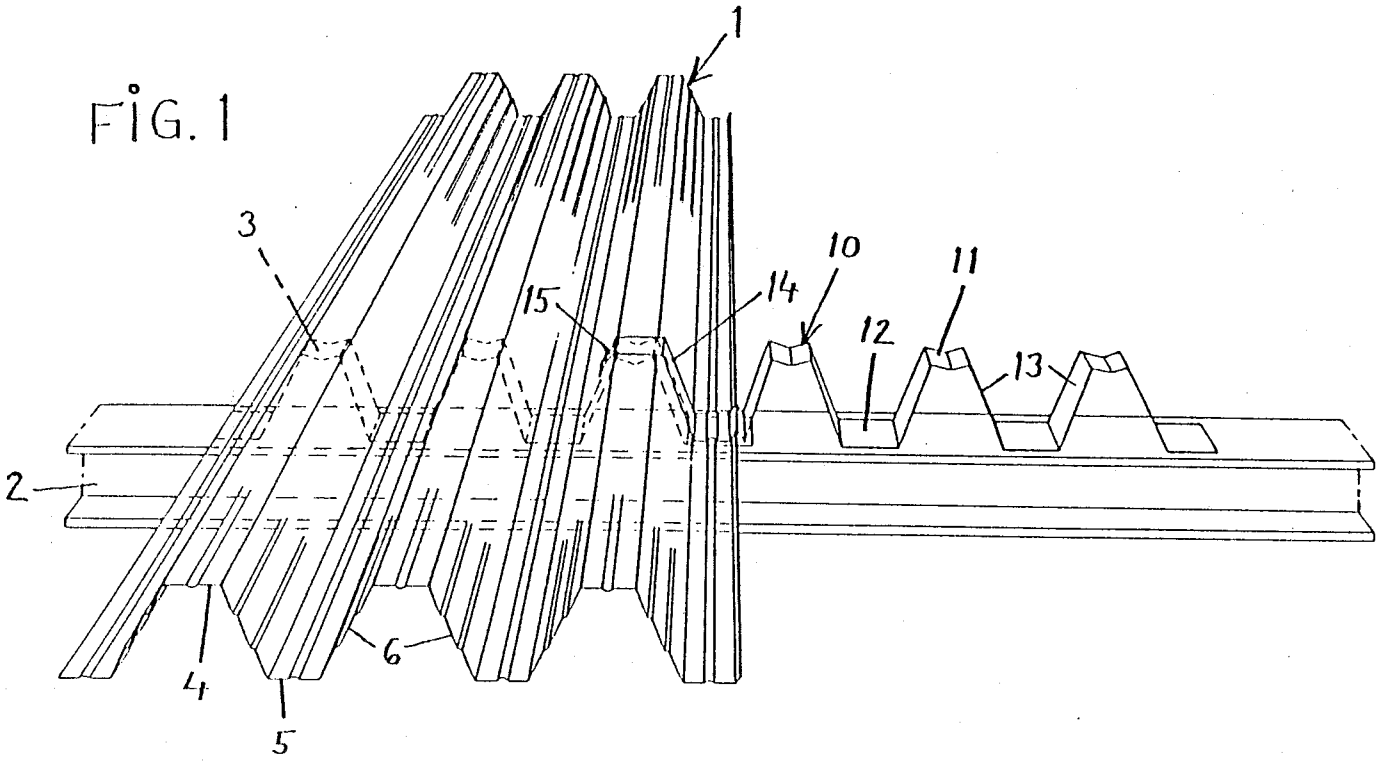
FIG. 1 is a perspective view as seen obliquely from above of a section of a beam and a profiled sheet placed thereon in a mounting phase.

FIG. 1 shows a profiled sheet 1 placed on a roof structural member or beam 2 in a roof truss, a supporting member 3 being placed between the profiled sheet 1 and the beam 2, the supporting member having a profiling at least partly connecting to the form of the profiled sheet so that the latter is reinforced and its deformation resistance improved. The profiled sheet 1 has crowning sections 4, valley sections 5 and flank sections 6. Of course the profiled sheet 1 rests on more than one beam 2, but for reasons of simplification only one beam is shown in the drawings. The sheet 1 is connected to the beam 2 by screws into the beam through at least some of the valley sections 5 of the sheet and the screw also passes through the supporting member 3 so that this is also fixed to the beam 2. Of course other fastening elements than screws can be used when anchoring the sheet 1 and supporting member 3 to the beam 2.

According to the invention an inventive supporting member 10 is first laid out on the beam, one end of which is so formed that it connects to the profiled sheet 1 in an upwardly guiding way. The upwardly guiding connection can be embodied in different ways and FIG. 1 shows an example wherein the supporting member 10 is formed at one end so that it connects to the upper surface of the profiled sheet 1 following this up to and over a crest 4. Thus, it is essential in this connection that the supporting member 10 is shaped so that it overlaps the sheet 1 in such a way that it is perfectly upwardly guided with respect to the beam 2.

Figure 2:
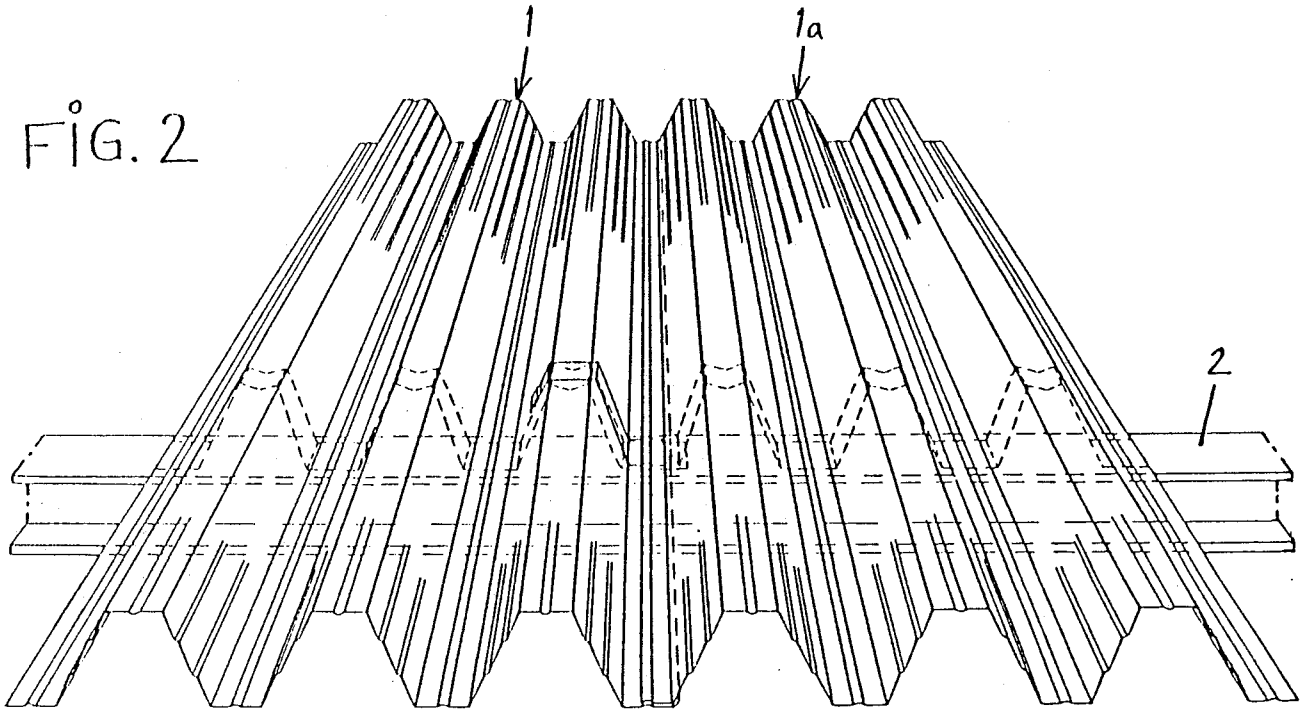
FIG. 2 is a view similar to FIG. 1 but showing another profiled sheet laid out.

The next step is to lay out another profiled sheet 1*a*, as shown in FIG. 2, and to anchor this and the supporting member 10 to the beam 2 in the manner previously described. Another supporting member 10 is thereafter placed on the beam 2 and on top of this still another profiled sheet, etc.

The supporting member 10 has a profiling substantially connecting to the profiled sheet 1, resulting in that the supporting member will have crest sections 11, valley sections 12 and flank sections 13. According to the embodiment in FIGS. 1 and 2 the supporting member 10 has an end section 14 connecting to the upper side of the profiled sheet 1 in an upwardly guiding way. The end section 14 preferably terminates with a turned-down edge section 15.

Thus, in the embodiment according to FIGS. 1 and 2 the supporting member 10 is located beneath the sheet 1*a* and, at the same time, located with its end section 14 on top of the previously laid-out sheet 1. This is also shown in FIG. 2.

Figure 3A:
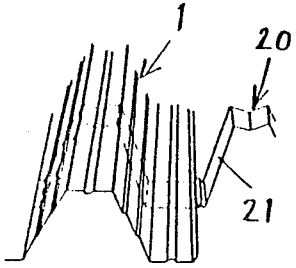
FIG. 3*a* is a perspective view showing another embodiment of supporting members.
Figure 3B:
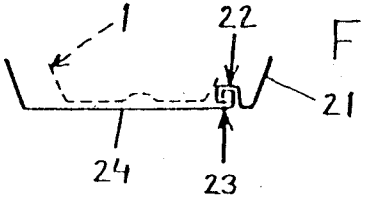
FIG. 3*b* is a schematic cross-sectional view of part of FIG. 3*a;*

FIGS. 3*a* and 3*b* show an alternative embodiment of an inventive supporting member which is here designated by 20. At its end 21 the supporting member 20 is formed with a hooking member 22 intended to engage and receive a hooking member 23 in an upwardly guiding way, said hooking member 23 being disposed in an end section 24 of another supporting member 20. As a result of this the supporting member 20 will have a hooking member 22 at one end and a hooking member 23 at its other end. After a first supporting member 20 has been placed on a beam 2 and a first profiled sheet 1 on top of this a second supporting member 20 is laid out according to the invention so that the hooking member 22 of this engages the hooking member 23 of the previously laid-out supporting member, a perfect upwardly guiding connection being obtained in this way, after which a second profiled sheet 1 is laid out, etc.

Figure 4A:
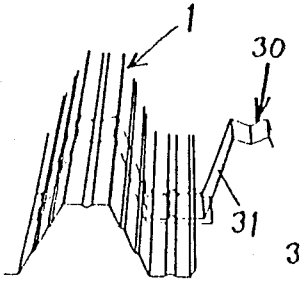
FIG. 4*a* is a perspective view showing a third embodiment of supporting members.
Figure 4B:
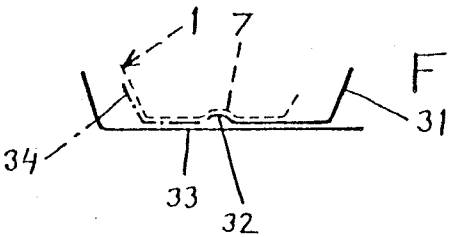
FIG. 4*b* is a cross-sectional view of part of FIG. 4*a.*

FIGS. 4*a* and 4*b* show another embodiment of an inventive supporting member here designated by 30. At one end section 31 of the supporting member 30 is so formed that it connects to the underside of the previous laid-out profiled sheet 1 in an upwardly guiding way. The end section 31 has a ridge or rib 32 connecting in a form-locking way to a corresponding groove 7 of the profiled sheet 1. In order to further improve the upwardly guiding connection, or if no groove is used, the supporting member can be formed with an upturned edge section 34 as indicated by a dash-and-dot line in FIGS. 4*a* and 4*b*. The other end section 33 of the supporting member 30 is flat. The supporting members 30 are laid out successively in such a way that the end 31 is pushed under a profiled sheet 1 already laid out so that the ridge 32 connects to the groove 7 of the sheet 1 in an upwardly guiding way, as shown in FIGS. 4*a* and 4*b*, the supporting member 30 being upwardly guided relative to the beam 2 so that the next profiled sheet can be laid out after which a new supporting member 30 is laid out, etc.

Common to all the embodiments of the invention is that the supporting members are so embodied that they connect to a previously laid-out profiled sheet or a previously laid-out supporting member in an upwardly guiding way so that the inventive successive laying-out procedure is made possible.

It should be pointed out that of course it may be suitable to connect the supporting member to the beam or to a previously laid-out sheet by means of a separate fastening element, for example a screw, so that the upwardly guided supporting member according to the invention maintains for certain its position until a sheet laying on top thereof is positioned.

It will be realized that the supporting members can be formed in a plurality of different ways within the scope of the inventive idea, and therefore the illustrative examples shown here must not be taken as limiting ones.

Great possibilities of variation are also present in respect of the final anchorage of the profiled sheets and the supporting members relative to the beams.

Thus, the invention is not restricted to what has been shown and described but amendments and modifications thereof are possible within the scope of the appended claims.

We claim:

1. In a roofing structure wherein profiled roofing sheets are supported on at least one roof structural member by profiled supporting members between the at least one roof structural member and roofing sheets, and the roofing sheets and supporting members are attached to the at least one roof structural member, each roofing sheet having an inner surface facing the at least one roof structural member and an outer surface on the opposite side of said roofing sheet, the improvement comprising:

a plurality of roofing sheets each having a cross-sectional profile formed by valley portions for positioning adjacent the at least one roof structural member, crest portions spaced outwardly from said valley portions relative to the at least one roof structural member, sidewall portions between said crest portions and valley portions, and first and second end valley portions extending from end sidewall portions at opposite ends of each roofing sheet, said first end valley portion of one roofing sheet overlapping said second end valley portion of an adjacent roofing sheet;

a plurality of supporting members each having a cross-sectional profile for interfitting between at least one of said roofing sheets and the roof structural support member and in engagement with at least part of the inner surface of said at least one roofing sheet; and end portions on each supporting member, one of said supporting member end portions overlapping said second end valley portion, end sidewall portion adjacent to said second end valley portion and end crest portion adjacent to the overlapped end sidewall portion of an adjacent roofing sheet.

2. The improved roofing structure as claimed in claim 1 wherein:

said cross-sectional profile of each supporting member comprises valley portions, crest portions, and sidewall portions between said valley and crest portions of said supporting member;

said one end portion on said supporting member comprises an end valley portion having a cross-sectional shape substantially conforming to the outer surface of said overlapped second end valley portion of the adjacent roofing sheet, an end crest portion extending over the outer surface of said overlapped end crest portion of said adjacent roofing sheet, an end sidewall portion between said overlapped end crest portion and said overlapped end valley portion of said end portion of said supporting member, and a turned-down edge section extending over a part of the sidewall portion of the adjacent roofing sheet adjacent to and on the side of said overlapped end crest portion opposite to said end sidewall portion thereof.

3. The improved roofing structure as claimed in claim 2 wherein:

the other end portion of said supporting member comprises a flat end flange underlying said second end valley portion of said adjacent roofing sheet.

4. The improved roofing structure as claimed in claim 1 wherein:

each supporting member comprises an elongated strip.

5. The improved roofing structure as claimed in claim 2 wherein:

each supporting member comprises an elongated strip.

6. The improved roofing structure as claimed in claim 3 wherein:

each supporting member comprises an elongated strip.

7. In a supporting member for profiled roofing sheets arranged in adjacent relationship wherein each roofing sheet is attached to a roof structural member with the supporting member between the roofing sheet and roof structural member, each roofing sheet having inner and outer surfaces, a cross-sectional profile formed by valley portions, crest portions and sidewall portions between said valley and crest portions and respective end portions overlapping and underlying respective end portions of adjacent roofing sheets the improvement wherein the supporting member comprises:

an elongated strip member having a profiled longitudinal cross-sectional shape for fitting the profiled shape of the inner surface of the roofing sheet with partial contacting engagement therewith; and one end portion on said strip member having a shape substantially conforming to the outer surface of one end portion of an adjacent roofing sheet for overlying in connecting relationship with said outer surface of said one end portion and comprising an end valley portion, end crest portion and end sidewall portion between said end valley portion and end crest portion of said strip member for overlapping end valley, end crest and end sidewall portions, respectively, of an adjacent roofing sheet.

8. In a roofing structure wherein profiled roofing sheets are supported on at least one roof structural member by profiled supporting members between the at least one roof structural member and roofing sheets, and the roofing sheets and supporting members are attached to the at least one roof structural member, each roofing sheet having an inner surface facing the at least one roof structural member, the improvement comprising:

a plurality of roofing sheets each having a cross-sectional profile formed by valley portions for positioning adjacent the at least one roof structural member, crest portions spaced outwardly from said valley portions relative to the at least one roof structural member, sidewall portions between said crest portions and valley portions, first and second end portions extending from end sidewall portions at opposite ends of each roofing sheet, said first end portion of one roofing sheet overlapping said second end portion of an adjacent roofing sheet, and a groove in each end portion;

supporting members each having a cross-sectional profile for interfitting between at least one of said roofing sheets and the roof structural support member and in engagement with at least part of the inner surface of said at least one roofing sheet;

end portions on each supporting member, one of said supporting member end portions having a flat shape for engagement with the at least one roof structural member;

the other end portion on each supporting member overlapping said one end portion of an adjacent supporting member and underlying said second end portion of said adjacent roofing sheet;

a rib on said other end portion of said supporting member interengaging with said groove in said second end portion of said roofing sheet; and an upturned edge portion on said other end portion on said supporting member substantially conforming to and engaging with the sidewall portion of said overlapped second end portion of said adjacent roofing sheet.

9. The improved roofing structure as claimed in claim 8 wherein:

each supporting member comprises an elongated strip.

* * * * *